US008151495B2

(12) United States Patent
Kim et al.

(10) Patent No.: US 8,151,495 B2
(45) Date of Patent: Apr. 10, 2012

(54) SUPPLEMENTAL CLOTHES TREATING APPARATUS

(75) Inventors: Myung Shik Kim, Changwon-si (KR); Ho Il Jeon, Changwon-si (KR); Jong Hee Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 552 days.

(21) Appl. No.: 12/269,613

(22) Filed: Nov. 12, 2008

(65) Prior Publication Data

US 2009/0133298 A1 May 28, 2009

(30) Foreign Application Priority Data

Nov. 12, 2007 (KR) ..... 10-2007-0114784

(51) Int. Cl.
*D06F 58/10* (2006.01)
*D06F 57/00* (2006.01)

(52) U.S. Cl. ..... 38/14; 38/1 A

(58) Field of Classification Search ..... 38/1 A, 38/14, 1 R; 223/69, 70, 73; 68/222
See application file for complete search history.

(56) References Cited

U.S. PATENT DOCUMENTS

| | | | | |
|---|---|---|---|---|
| 1,759,179 | A | 5/1930 | Wiesman | |
| 3,595,450 | A * | 7/1971 | Schlemon et al. | 223/57 |
| 3,856,190 | A * | 12/1974 | Mole et al. | 223/94 |
| 4,493,160 | A * | 1/1985 | Brembilla et al. | 38/14 |
| 5,305,484 | A | 4/1994 | Fitzpatrick et al. | |
| 5,815,961 | A * | 10/1998 | Estes et al. | 38/14 |
| 2004/0163184 | A1 * | 8/2004 | Waldron et al. | 8/149.1 |

FOREIGN PATENT DOCUMENTS

| | | | |
|---|---|---|---|
| DE | 91 02 303 | U1 | 6/1991 |
| DE | 20 2006 000 337 | U1 | 6/2007 |
| EP | 1808523 | A2 | 7/2007 |
| GB | 2 094 840 | A | 9/1982 |
| GB | 2 238 322 | A | 5/1991 |

* cited by examiner

*Primary Examiner* — Ismael Izaguirre
(74) *Attorney, Agent, or Firm* — Birch, Stewart, Kolasch & Birch, LLP

(57) ABSTRACT

A supplemental clothes treating apparatus is disclosed. A supplemental clothes treating apparatus includes a housing which defines an exterior appearance thereof, the housing having an accommodation space where clothes are accommodated; a tensile force supply unit which applies a tensile force to the clothes accommodated in the accommodation space of the housing; and a hot air supply device which supplies hot air to the clothes.

10 Claims, 8 Drawing Sheets

SUPPLEMENTAL CLOTHES TREATING APPARATUS

This application claims the benefit of the Patent Korean Application No. 10-2007-0114784, filed on Nov. 12, 2007, which is hereby incorporated by reference as if fully set forth herein.

BACKGROUND OF THE INVENTION

1. Field of the Invention

The present invention relates to a supplemental clothes treating apparatus. More particularly, the present invention relates to a supplemental clothes treating apparatus capable of removing wrinkles of clothes efficiently.

2. Discussion of the Related Art

Clothes treating apparatuses typically includes washing machines for washing clothes and dryers for drying washed clothes. Recently has been used quite a lot a single combination clothes treating apparatus configured of such the washing machine and dryer.

In this kind of the clothes treating apparatus, the washing machine and the dryer are adjacent to each other. Here, a supplemental clothes treating apparatus may be provided under the washing machine and the dryer or between the washing machine and the dryer to accommodate clothes.

If the supplemental clothes treating apparatus is positioned under the washing machine and the dryer, the washing machine and dryer may be heightened a predetermined distance from the floor for user convenience. In addition, if the supplemental clothes treating apparatus is positioned between the washing machine and the dryer, clothes may be accommodated and kept in the supplemental clothes treating apparatus.

However, because of friction between the clothes and a drum provided in the clothes treating apparatus, there may be wrinkles on the clothes having been washed and dried. As a result, it is inconvenient and unpleasant for the user to put on the washed and dried clothes immediately and these clothes having wrinkles need additional ironing.

SUMMARY OF THE INVENTION

Accordingly, the present invention is directed to a supplemental clothes treating apparatus.

An object of the present invention is to provide a supplemental clothes treating apparatus capable of removing wrinkles of clothes by applying a tensile force to clothes before spraying steam.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a supplemental clothes treating apparatus includes a housing which defines an exterior appearance thereof, the housing having an accommodation space where clothes are accommodated; a tensile force supply unit which applies a tensile force to the clothes accommodated in the accommodation space of the housing; and a hot air supply device which supplies hot air to the clothes.

The tensile force supply unit may apply the tensile force to the clothes in a longitudinal direction of the clothes.

The tensile force supply unit may include a clothes-hanging member installed at an upper portion of the housing to support an upper portion of the clothes; and a lower supporting member installed at a lower portion of the housing to support a lower portion of the clothes.

A distance between the clothes-hanging member and the lower supporting member may be adjustable.

The clothes-hanging member may include a wing part where the clothes are hung; and a vertical bar having an end coupled to an upper surface of the housing and the other end coupled to the wing part, the length of the vertical bar being adjustable.

The lower supporting member may include a case installed at the lower portion of the housing, the height of the case being adjustable; and a securing member coupled to an upper portion of the case to secure the lower portion of the clothes selectively.

The hot air supply device may be provided at the lower frame to supply hot air to the lower portion of the clothes or the lower and side portion of the clothes.

The supplemental clothes treating apparatus may further include a steam generation device which sprays steam to the clothes selectively.

The steam generation device the steam upward from the lower portion of the clothes.

The steam generation device may include a water storage part installed in the housing to accommodate water; a steam generator heating the water supplied from the water storage part to generate steam; and a spray nozzle spraying the steam generated by the steam generator toward the clothes.

The water storage part and the steam generator may be installed in the lower portion of the housing.

The spray nozzle may be installed at the portion of the housing to spray the steam upward.

The water storage part may be separable from the housing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
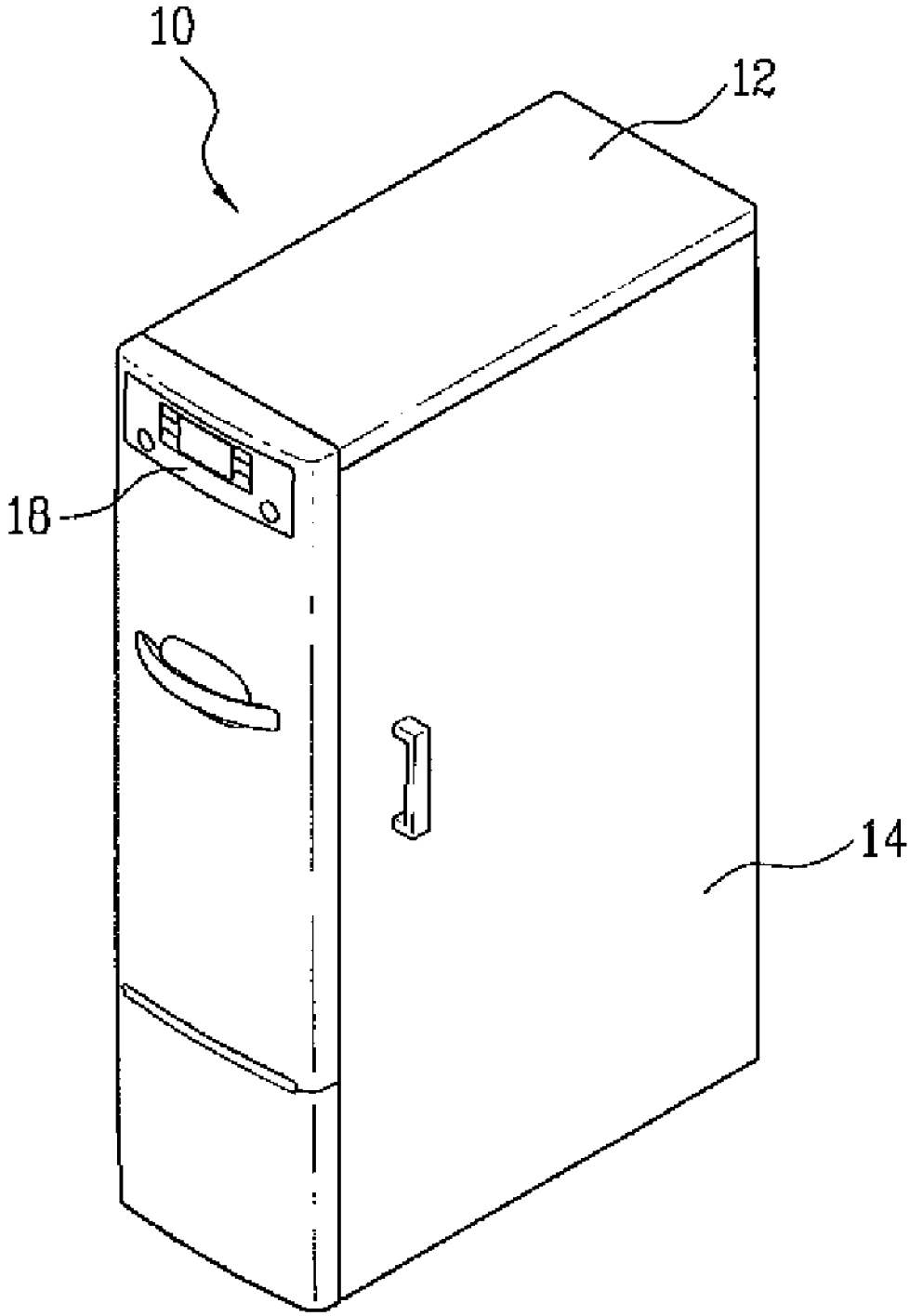
FIG. 1 is a perspective view illustrating that a supplemental clothes treating apparatus according to an exemplary embodiment is provided adjacent to other clothes treating apparatuses.

FIG. 1 is a perspective view illustrating a supplemental clothes treating apparatus according to an exemplary embodiment.

The supplemental clothes treating apparatus may be provided singly and it is preferable that the supplemental clothes treating apparatus composes a combination clothes treating apparatus with other clothes treating apparatuses. If then, at least one clothes treating apparatus may be provided and it is preferable that the other clothes treating apparatuses are configured of a pair of a washing machine and a dryer. Here, if a single clothes treating apparatus is provided, the single clothes treating apparatus may be a washing machine performing washing or a washing machine having a drying function. If a pair of clothes treating apparatuses is provided, one of the pair may be a washing machine and the other may be a dryer provided adjacent to the washing machine.

The supplemental clothes treating apparatus according to the exemplary embodiment may be adjacent to the clothes treating apparatus composing the combination clothes treating apparatus.

In reference to FIG. 1, the supplemental clothes treating apparatus 10 includes a housing, a tensile force supply unit and a hot air supply device. The housing 12 accommodates clothes and the tensile force supply unit applies a predetermined tensile force to the clothes accommodated in the housing 12. The hot air supply device supplies hot air to the clothes.

The housing 12 defines an exterior appearance of the supplemental clothes treating apparatus 10 according to the exemplary embodiment and an accommodation space, where clothes are accommodated, is formed in the housing 12. An opening (13, see FIG. 2) is formed at the housing and the opening 13 is opened and closed by a door 14, such that a user may put the clothes in the housing 12 via the opening 13.

In addition, a control panel 18 is formed at the front surface of the housing 12 to control various operations of the supplemental clothes treating apparatus 10. The user operates the control panel 18 to control the supplemental clothes treating apparatus 10. Next, in reference to FIGS. 2 to 7, an inner structure of the supplemental clothes treating apparatus will be described.

Figure 2:
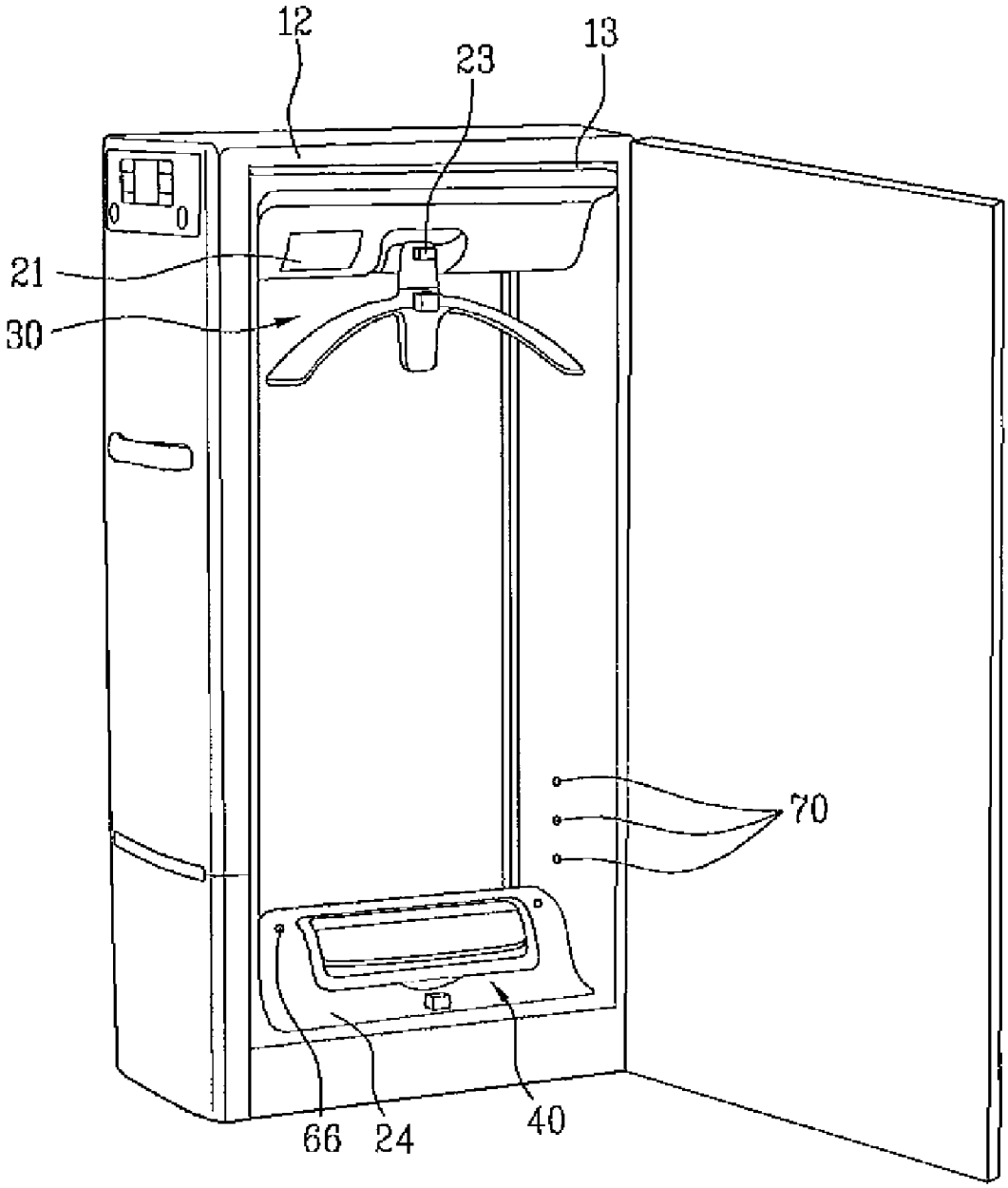
FIG. 2 is a perspective view illustrating only the supplemental clothes treating apparatus of FIG. 1.

FIG. 2 is a perspective view illustrating an inner configuration of the housing 12 according to the embodiment.

In reference to FIG. 2, in the housing are accommodated the clothes and provided the tensile force supply unit to apply a tensile force to the accommodated clothes. The tensile force supply unit applies a tensile force to the clothes put on an upper portion of the housing 12 in a longitudinal direction to give a predetermined tension to the clothes. This enables to be removed efficiently wrinkles generated on the clothes after spraying steam to the clothes, which will be described later.

If steam is sprayed to the clothes to remove the wrinkles, it is noticeably effective to pull the clothes tight by using the applied tension, before spraying steam, compared with to simply spray steam to the clothes. As a result, the supplemental clothes treating apparatus 10 according to the exemplary embodiment includes the tensile force supply unit to apply the tensile force to the accommodated clothes.

The tensile force supply device includes a clothes-hanging member 30 and a lower supporting member 40. The clothes-hanging member 30 is installed at the upper portion of the housing 12 to support an upper portion of a clothes item and the lower supporting member 40 is installed at a lower portion of the housing 12 to support a lower portion of the clothes item. Here, the clothes-hanging member 30 and the lower supporting member 40 are installed at the upper and lower portions of the housing 12, respectively, and a distance between the two members 30 and 40 in the housing 12 can be adjustable. That is, the upper and lower portion of the clothes item are secured to the clothes-hanging member 30 and the lower supporting member 40, respectively, and then the distance between the clothes-hanging member 30 and the lower supporting member 40 is adjusted, such that the tensile force may be applied to the clothes item. Next, a specific configuration of the clothes-hanging member 30 and the lower supporting member 40 will be described.

Figure 3:
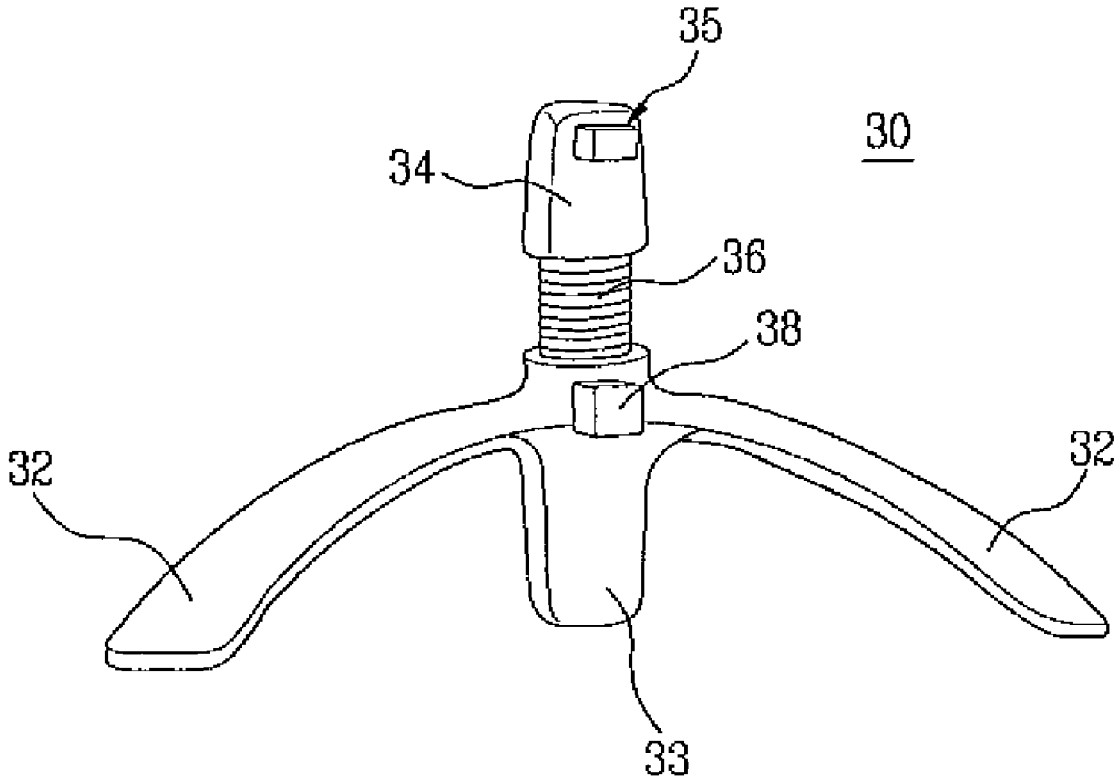
FIG. 3 is a perspective view illustrating a clothes-hanging member of FIG. 2.

FIG. 3 is a perspective view illustrating the clothes-hanging member 30 of FIG. 2.

In reference to FIG. 3, the clothes-hanging member 30 includes a pair of wing parts 32 and a vertical bar 34. The clothes may be hung on the wing parts 32 and the vertical bar 34 is movable along a perpendicular direction of the wing parts 32.

As shown in FIG. 3, the wing parts 32 are extending bisymmetrically in a right and left direction and the clothes are placed on the wing parts. The appearance of the wing part 32 is not limited to what has described above and it is preferable that the wing parts have a predetermined width to enlarge a contact area between the clothes and the steam, if the steam is supplied in an upward direction, which will be described later. If the wing parts 32 have the predetermined width, the clothes item on the wing parts 32 is spread forward and backward. As a result, the steam supplied upward may be supplied to the fabric of the clothes item deeply to enlarge the contact area between the clothes item and the steam.

In addition, an extension 33 is formed at a center portion between the pair of the wing parts 32 to support a rear portion of the clothes item placed on the wing parts 32. The extension 33 is extended downward from the center between the pair of the wing parts 32 to support a back of a shirt, such that the clothes item may be prevented from going down.

A vertical bar 34 is secured to an upper center portion between the pair of the wing parts 32. Here, an end of the vertical bar 34 is fixed to the upper portion of the housing 12 and the vertical bar 34 may adjust the distance with the wing parts 32. A through hole 35 is formed at a center of the vertical bar 34 and a fixing bar (not shown) formed at the inner upper portion of the housing 12 may pass the through hole 35 to secure the clothes-hanging member 30 to the upper portion of the housing 12.

As mentioned above, the distance between the vertical bar 34 and the wing parts 32 may be adjustable. The reason why the distance is adjustable is that the tensile force is applied to the clothes item. The configuration of the vertical bar 34 capable of adjusting the distance with the wing parts 32 may be embodied in various ways. Next, an embodiment will be described.

Figure 4:
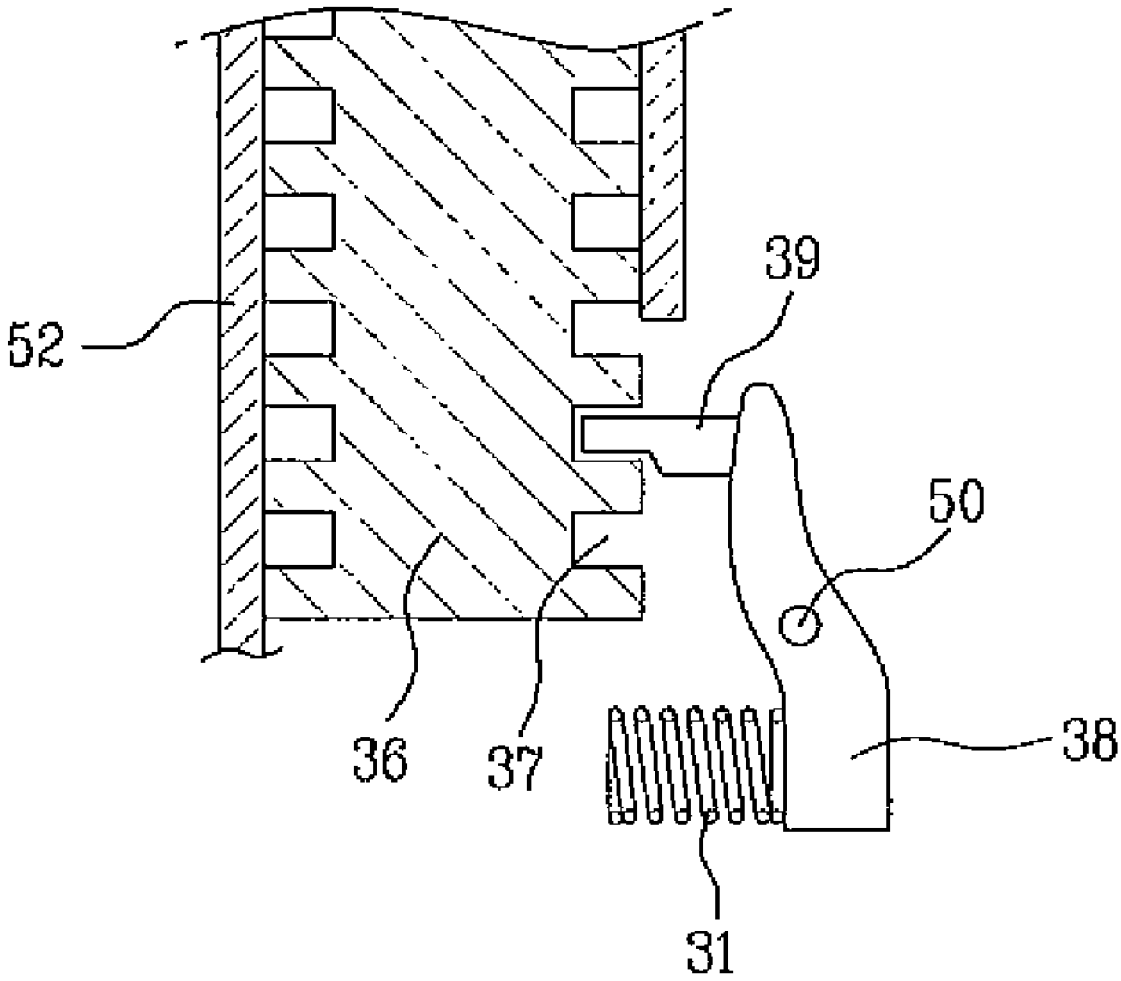
FIG. 4 is a diagram schematically illustrating a connection structure between a vertical bar and a wing parts.

FIG. 4 is a diagram schematically illustrating a connection structure between the vertical bar 34 and the wing parts 32 provided in the clothes-hanging member 30.

In reference to FIG. 4, a connection bar 36 is extended from a lower end of the vertical bar (34, see FIG. 3) and a button part 38 may be formed at the wing parts (32, see FIG. 3) to receive an elastic force from a spring 31. A plurality of fastening grooves 37 may be formed along an outer circumferential surface of the connection bar 36 in parallel in a right and left direction. That is, the plurality of the fastening grooves 37 are arranged vertically and continuously and an insertion 39 is formed at the button part 38 to be selectively inserted in the plurality of the fastening grooves 37. Here, the insertion 39 is formed at an end of the button part 38 and the spring 31 is provided at the other end of the button part 38. Also, the button part 38 is rotatable about a rotation shaft 50.

It is preferable that a guide member 52 is provided at an inner surface of the wing parts 32 to guide the motion of the connection bar 36. If the user adjusts the distance between the vertical bar 34 and the wing parts 32, the guide member 52 prevents the connection bar 36 from moving in a right and left direction. As a result, the connection bar 36 may be movable vertically and securely and the insertion 39 is securely inserted in the fastening groove 37 to secure the connection bar securely.

If trying to adjust the distance between the vertical bar 34 and the wing parts 32, the user pushes the button part 38 and the button part 38 is rotated to separate the insertion 39 from the fastening groove 37. After that, the user adjusts the distance between the vertical bar 34 and the wing parts 32. After adjusting the distance, the user remove the force of pressing the button part 38 and the button part 38 is re-rotated by the elasticity of the spring 31. Then, the insertion 39 is inserted in the fastening groove 37 to fix the distance between the vertical bar and the wing parts 32.

The above configuration of adjusting the distance between the vertical bar 34 and the wing parts 32 is one of embodiments and the present invention is not limited thereto, including variations of it. Next, the lower supporting member will be described.

Figure 5:
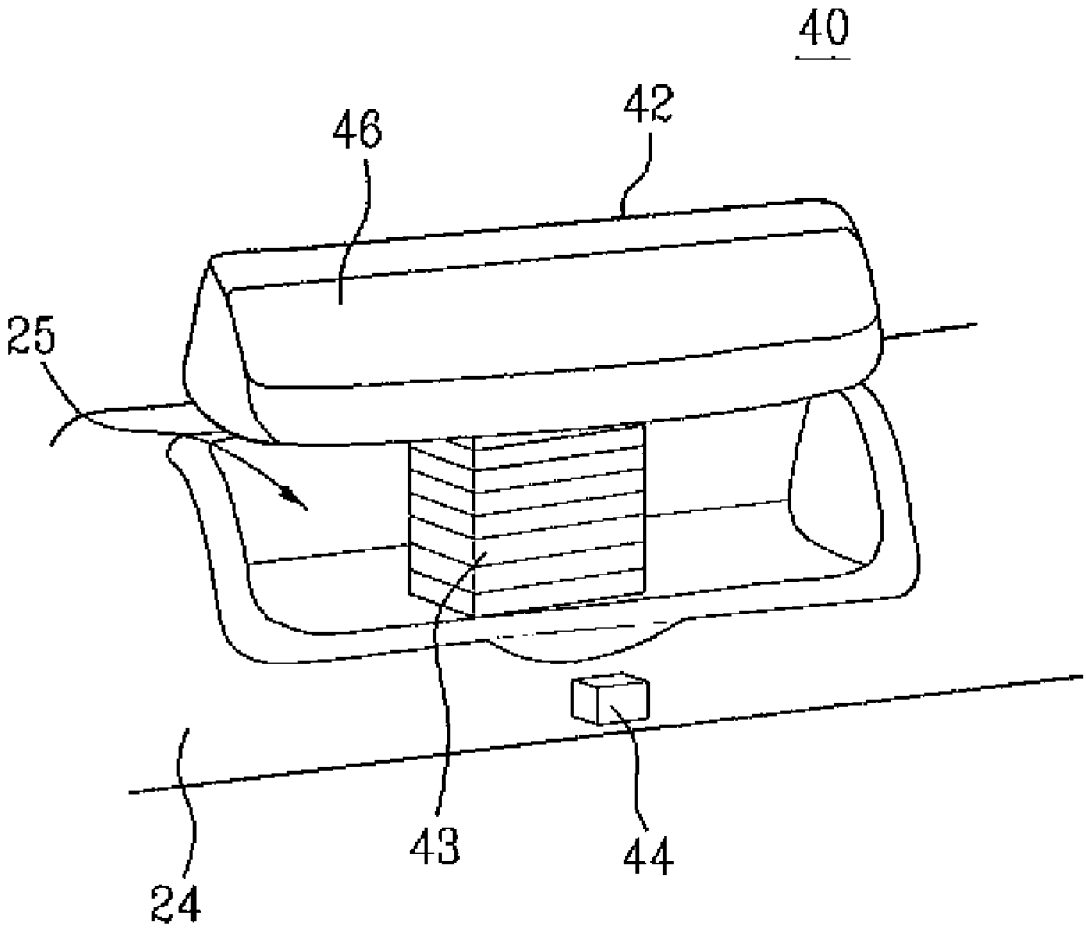
FIG. 5 is a perspective view illustrating a lower supporting member of FIG. 2.

FIG. 5 is a perspective view illustrating a lower supporting member of FIG. 2.

In reference to FIG. 5, the lower supporting member 40 includes a case 42 and a securing member 46. The case 42 is installed at an inner lower portion of the housing 12, being movable upward and downward, and the securing member 46 is rotatably coupled to an upper portion of the case 42 to secure a lower portion of the clothes item.

The case 42 has an open portion. According to this embodiment, a top of the case 42 is opened and the securing member 46 is rotatably installed in the case 42. The case 42 is mounted in a supporting groove 25 formed at the lower portion of the housing 12 and it is movable upward and downward to enable a distance from the supporting groove 25 to be adjusted. The configuration of the adjustment of the distance between the case 42 and the supporting groove 25 may be changed in various ways. For example, the plurality of the fastening grooves are formed at an outer circumferential surface of the connection bar 43 extended from the lower end of the case 42 and the button part 44 including the insertion (not shown) inserted in the fastening grooves is provided at the lower frame 24. This structure is similar to the structure of adjusting the distance between the wing parts 32 of the clothes-hanging member 30 and the vertical bar 34, and the detailed description thereof will be omitted accordingly.

In the meantime, the securing member 46 is rotatably installed at the upper portion of the case 42. The securing member 46 rotates between a securing position and a releasing position of the clothes to secure the lower portion of the clothes item. Here, the securing position is to secure the clothes item and the releasing position is not to secure the clothes item. Next, in reference to the corresponding drawing, the securing member 46 will be described in detail.

Figure 6:
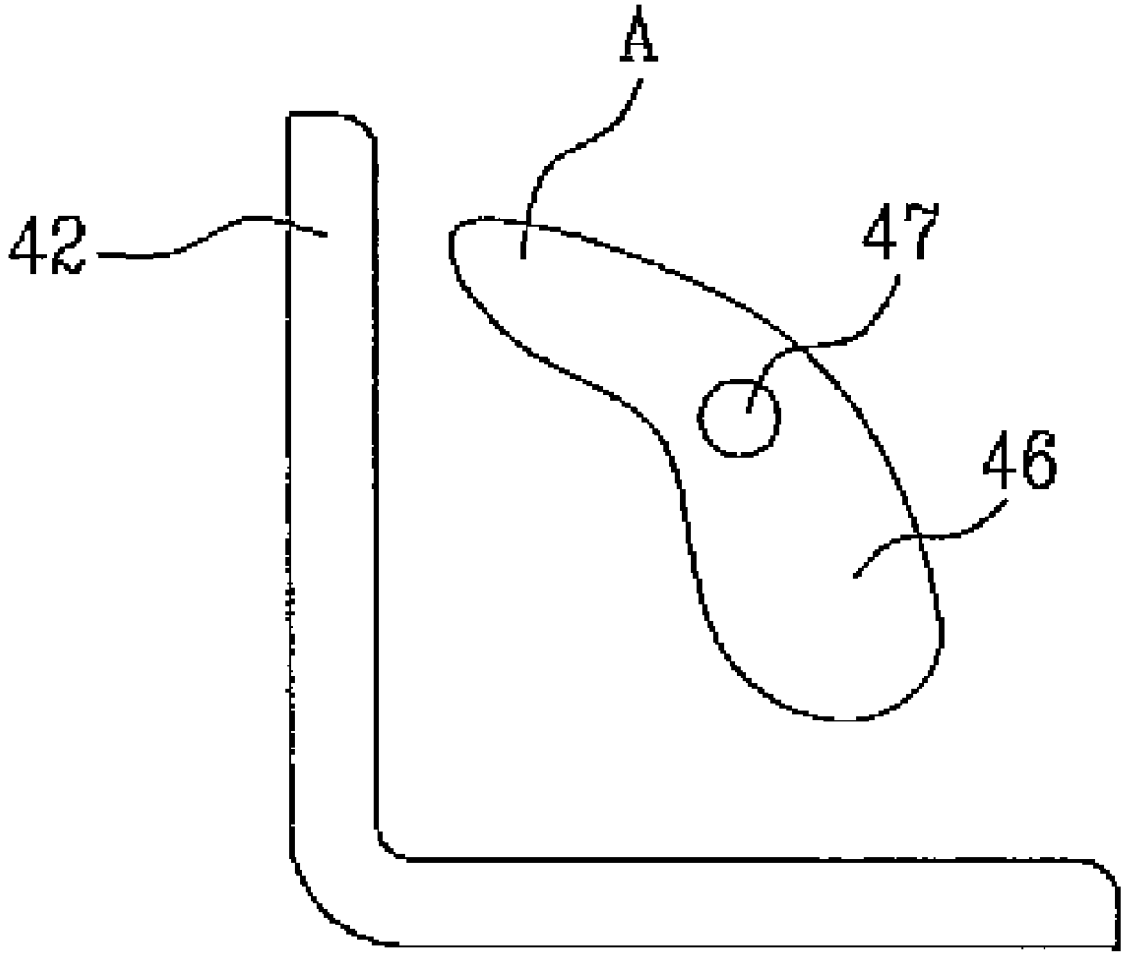
FIG. 6 is a sectional view illustrating a securing member of FIG. 5 being placed at a releasing position not to secure the clothes item.

FIG. 6 is a sectional view illustrating the securing member 46 placed at the releasing position.

In reference to FIG. 6, the securing member 46 is rotating about the rotation shaft 47.

If the securing member 46 is placed at the releasing position, an end (A) of the securing member 46 is spaced apart a predetermined distance from an inner surface of the case 42. As a result, if the clothes item is hung on the clothes-hanging member 30, the lower portion of the clothes item is positioned between the inner surface of the case 42 and the end (A) of the securing member 46, not to secure the lower portion of the clothes item.

Figure 7:
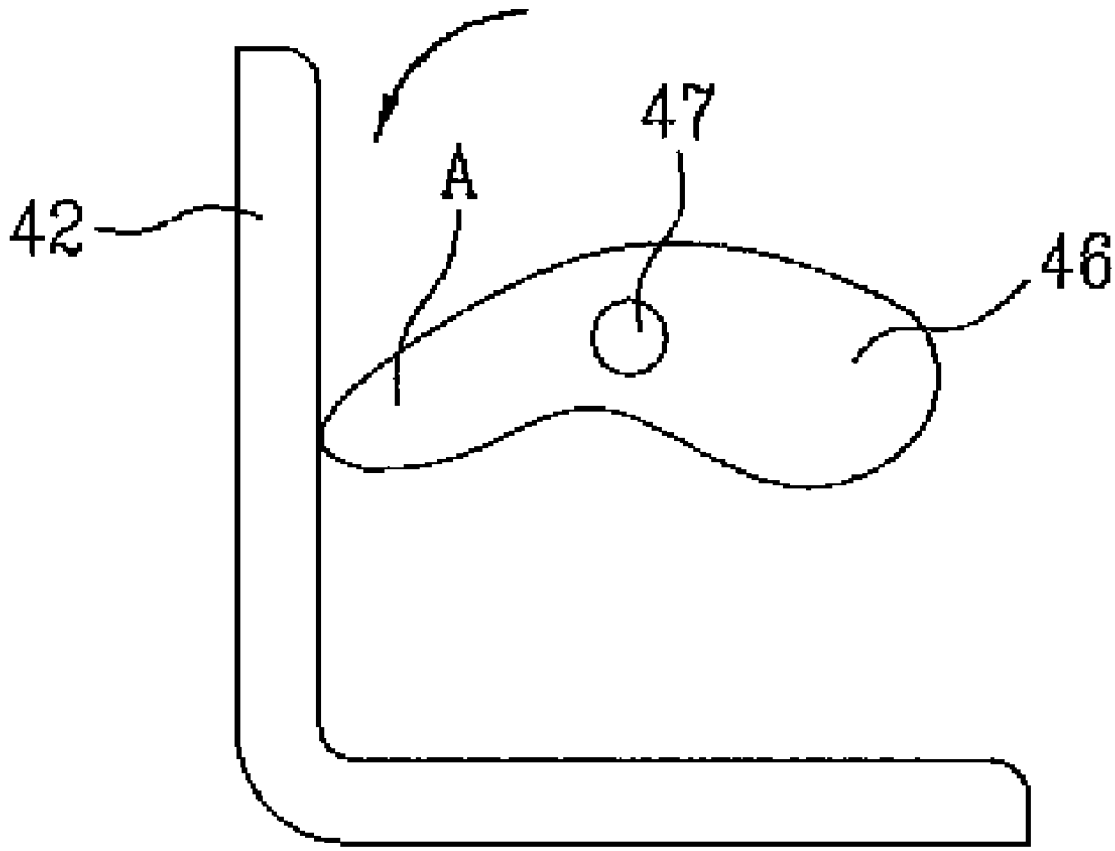
FIG. 7 is a sectional view illustrating the securing member placed at a securing position to secure the clothes item.

If the tensile force has to be applied to the clothes, the user rotates the securing member 46 to the securing position to secure the lower portion of the clothes item between the end (A) of the securing member 46 and the inner surface of the case 42, as shown in FIG. 7. If then, an external force is applied to the securing member 46 in a counter-clockwise direction and the securing member 46 is forcedly secured between the rotation shaft 47 and the inner surface of the case 42.

Hence, the upper portion of the clothes item put on the clothes-hanging member 30 is supported by the wing parts 32 and the lower portion of the clothes item is supported by the lower supporting member 40. If the tensile force has to be applied to the clothes item upward and downward in this state, the user just shortens the distance between the vertical bar 34 of the clothes-hanging member 30 and the wing parts 32, or the user shortens the distance between the case 42 of the lower supporting member 40 and the lower frame 24, only to apply the tensile force to the clothes item in a vertical direction.

As mentioned above, the supplemental clothes treating apparatus 10 includes a steam generation device (60, see FIG. 8) for selectively supplying steam to the clothes item secured between the clothes-hanging member 30 and the lower supporting member 40 and a hot air supply device (not shown) for supplying hot air to the clothes item. Next, in reference to FIG. 2, the steam generation device 60 and the hot air supply device will be described.

In reference to FIG. 2 again, it is preferable that the hot air supply device may be provided in the housing 12.

If heated, the hot air should have a property of ascending and it is preferable that a hot air supply nozzle 70 is provided at the lower portion of the housing 12. That is, the hot air supplied via the hot air supply nozzle 70 rises to contact with the clothes and to maintain the clothes at a proper temperature, which can cause a refresh effect.

Such the hot air supply device may be changeable in various ways. For example, a fan (not shown) and a heater (not shown) are provided at an inner portion of the housing 12 and the air drawn into the hot air supply device by the fan is heated by the heater such that the hot air may be supplied to the clothes via the hot air supply nozzle 70. Hence, the air having a temperature relatively lowered by the contact with the clothes may be circulated by the fan again.

According to the latter example, the hot air supply device may be configured of a fan and a heat pump. Here, the heat pump includes a compressor, a condenser, an expansion valve and an evaporator, where refrigerant is flowing. The air blown by the fan may heat-exchange with the refrigerant, passing the condenser and the compressor. Then, the air is heated and the heated air is supplied to the housing 12. The air having the temperature lowered by the contact with the clothes is recirculated by the fan.

As mentioned above, the supplemental clothes treating apparatus includes the steam generation device 60 which selectively sprays steam to remove wrinkles of the clothes accommodated therein.

Figure 8:
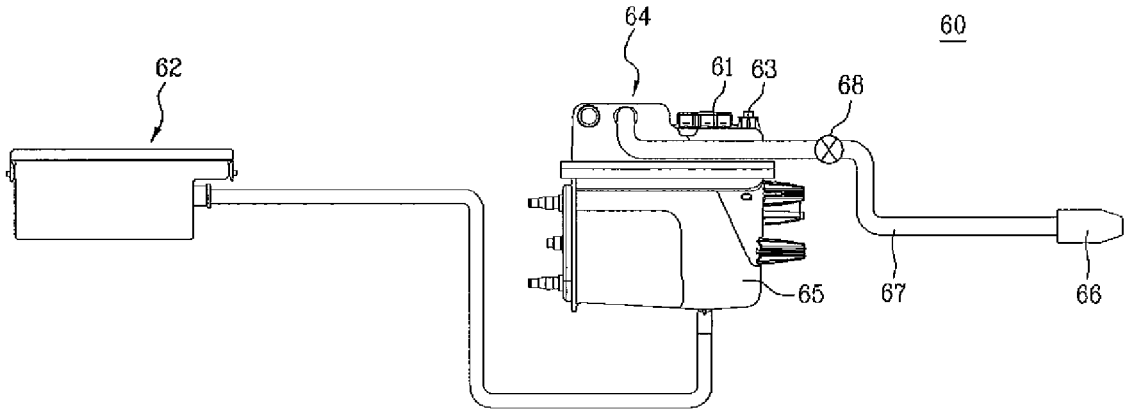
FIG. 8 is a diagram schematically illustrating a configuration of a steam generation device provided in the supplemental clothes treating apparatus according to the exemplary embodiment.

FIG. 8 is a diagram schematically illustrating a configuration of the steam generation device 60.

In reference to FIG. 8, the steam generation device 60 includes a water storage part 62, a steam generator 64 and a steam spray nozzle 66. Water is stored in the water storage part 62. The steam generator 64 heats the water supplied from the water storage part 62 to generate steam. The steam generated at the steam generator 64 is sprayed toward the clothes via the steam spray nozzle 66.

At this time, the water storage part 62 supplies the water required to generate steam to the steam generator 64. It is preferable to install the water storage part 62 at the upper portion of the housing 12. If the water storage part 62 is installed at the upper portion of the housing 12, it is possible to install the steam generator 64 at the lower portion of the housing 12, such that the water of the water storage part 62 may be supplied to the steam generator 64 by water head difference. As a result, an auxiliary pump is not necessary to supply water to the steam generator 60 from the water storage part 62 and the water supply may be adjustable only if an opening control unit 68 such as a valve is provided.

At this time, the water storage part 62 may be fixed to the upper portion of the housing 12 and it is preferable that the water storage part 62 is separable. That is, the water storage part 62 is detachable via a door 21 installed at the upper portion of the housing 12. If the water of the water storage part 62 lacks, the user can separate only the water storage part 62 from the upper frame 22 and fills the water storage part 62 with water. Hence, the user may re-connect the water storage part 62 and water may be supplied to the water storage part 62 conveniently.

As mentioned above, the steam generator 64 is installed at the lower frame 24. The steam generator 60 includes a case 65 having a predetermined volume capable of accommodating water and a heater (not shown) provided therein to heat the accommodated water. The water is heated by the heater and steam is generated and the generated steam is supplied to the steam spray nozzle 66 along a steam supply line 67. In addition, a valve 68 may be provided at the steam supply line 67 and the valve 68 is selectively closable by a control part (not shown). The control part opens and closes the valve 68 to control the steam supplied to the steam spray nozzle 66 or to control the amount of steam.

A water level sensor 61 may be further provided to sense whether the water is supplied enough to the steam generator 64 or a temperature sensor 63 may be further provided to sense whether the steam generator 64 is operated normally. Values measured by the water level sensor 61 or the temperature sensor 63 are transmitted to the control part. If the water level is low, the control part informs the user of the lack of the water by using an alarm or warning light. Also, if the temperature of the steam generator 64 is abnormally high or low, the control part informs the user of the abnormality.

It is preferable that the steam spray nozzle 66 is installed at the lower portion of the housing 12 or a lower portion of the side frame 26. The steam is high temperature and the steam has a property of ascending. As a result, if the steam spray nozzle 66 is provided at the upper or side portion of the housing 12, an area of the clothes in contact with the steam is reducing because of the property of ascending and it is preferable that the steam spray nozzle 66 is installed at the lower portion of the housing 12 accordingly. The steam sprayed via the steam spray nozzle 66 rises and contacts with the clothes to remove wrinkles of the clothes.

In reference to the corresponding drawings, an operation of the supplemental clothes treating apparatus having the above configuration will be described.

First of all, the user retracts the movable frame 20 from the housing 12 to hang the clothes item on the clothes-hanging member 30. In this case, if the user wises to remove wrinkles of the clothes item by spraying steam, the tensile force is applied to the clothes item in an upward and downward direction by using the clothes-hanging member 30 and the lower supporting member 40. That is, the lower portion of the clothes item is secured to the lower supporting member 40 and then the distance between the vertical bar 34 and the wing parts 32 of the clothes-hanging member 30 is shortened, only to apply the tensile force to the clothes item. Hence, the movable frame 20 is retracted into the housing 12 again and the door 14 closes the opening 13. After that, the door 14 is closed.

Hence, the user operates the control panel 18 to control the operation of the supplemental clothes treating apparatus. The user's operation of the control panel 18 enables the control part to control the hot air supply device and the steam generation device 60. The control part operates the hot air supply device to supply hot air or the steam generation device to generate and spray steam via the steam spray nozzle 60. In this case, the hot air or steam supplied upward from the lower portion of the clothes item may contact with the clothes item to refresh the clothes as well as to remove wrinkles of the clothes pulled tight upward and downward.

Once the hot air or steam is sprayed for a preset time period according to a selected course, the user can take out the clothes item to put on immediately.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A supplemental clothes treating apparatus comprising:

a housing which defines an exterior appearance thereof, the housing having an accommodation space where clothes are accommodated;

a tensile force supply unit which applies a tensile force to the clothes accommodated in the accommodation space of the housing; and a hot air supply device which supplies hot air to the clothes, wherein the tensile force supply unit comprises:

a clothes-hanging member installed at an upper portion of the housing to support an upper portion of the clothes; and a lower supporting member installed at a lower portion of the housing to support a lower portion of the clothes, wherein the lower supporting member comprises:

a case installed at the lower portion of the housing, the installing height of the case being adjustable; and a securing member coupled to an upper portion of the case to secure the lower portion of the clothes selectively.

2. The supplemental clothes treating apparatus of claim 1, wherein the tensile force supply unit applies the tensile force to the clothes in a longitudinal direction of the clothes.

3. The supplemental clothes treating apparatus of claim 1, wherein a distance between the clothes-hanging member and the lower supporting member is adjustable.

4. The supplemental clothes treating apparatus of claim 1, wherein the hot air supply device is provided at the lower frame to supply hot air to the lower portion of the clothes or the lower and side portion of the clothes.

5. The supplemental clothes treating apparatus of claim 1, further comprising:

a steam generation device which sprays steam to the clothes selectively.

6. The supplemental clothes treating apparatus of claim 5, wherein the steam generation device supplies the steam upward from the lower portion of the clothes.

7. The supplemental clothes treating apparatus of claim 6, wherein the steam generation device comprises:

a water storage part installed in the housing to accommodate water;

a steam generator heating the water supplied from the water storage part to generate steam; and a spray nozzle spraying the steam generated by the steam generator toward the clothes.

8. The supplemental clothes treating apparatus of claim 7, wherein the water storage part and the steam generator are installed in the lower portion of the housing.

9. The supplemental clothes treating apparatus of claim 7, wherein the spray nozzle is installed at the portion of the housing to spray the steam upward.

10. The supplemental clothes treating apparatus of claim 8, wherein the water storage part is separable from the housing.

* * * * *